US006393802B1

(12) United States Patent
Bowser et al.

(10) Patent No.: US 6,393,802 B1
(45) Date of Patent: May 28, 2002

(54) CYLINDER FILLER FOR USE WITH AN OXYGEN CONCENTRATOR

(75) Inventors: Karl Bowser, Friedens; Greg Clites, Meyersdale; Frank Frola, Somerset; Jesse Moore, Rockwood, all of PA (US)

(73) Assignee: Sunrise Medical HHG, Inc., Longmont, CO (US)

( * ) Notice: Subject to any disclaimer, the term of this patent is extended or adjusted under 35 U.S.C. 154(b) by 0 days.

(21) Appl. No.: 09/470,523

(22) Filed: Dec. 22, 1999

(51) Int. Cl.[7] ..... B65B 31/00
(52) U.S. Cl. ..... 53/403
(58) Field of Search ..... 53/403; 128/205.12, 128/205.18, 204.18, 207.26; 141/1–5, 11, 18

(56) References Cited

U.S. PATENT DOCUMENTS

| | | | | |
|---|---|---|---|---|
| 4,662,154 A | | 5/1987 | Hayward | 53/431 |
| 4,670,223 A | * | 6/1987 | Delachapelle | 422/122 |
| 4,856,284 A | | 8/1989 | Mattiola et al. | 62/55 |
| 4,987,932 A | * | 1/1991 | Pierson | 141/1 |
| 5,558,139 A | | 9/1996 | Snyder | 141/95 |
| 5,562,132 A | | 10/1996 | Siegele et al. | 141/198 |
| 5,649,577 A | | 7/1997 | Farkas | 141/198 |
| 5,858,062 A | | 1/1999 | McCulloh et al. | 95/8 |
| 5,988,165 A | * | 11/1999 | Richey, II et al. | 128/205.12 |

FOREIGN PATENT DOCUMENTS

SU 1176135 A 8/1985

* cited by examiner

*Primary Examiner*—John Sipos
*Assistant Examiner*—Hemant M. Desai
(74) *Attorney, Agent, or Firm*—MacMillan, Sobanski & Todd LLC

(57) ABSTRACT

An oxygen concentrator for supplying supplemental oxygen to a patient. The oxygen concentrator is adapted to supply supplemental oxygen directly to the patient and/or to a cylinder filler which is controlled to automatically fill a portable oxygen cylinder for use by an ambulatory patient. The cylinder filler is controlled to check the initial gas pressure in the cylinder prior to filling. If the initial cylinder pressure is below a preset minimum pressure, the cylinder filler will not fill the cylinder so that an empty cylinder which may be contaminated cannot be filled.

9 Claims, 1 Drawing Sheet

CYLINDER FILLER FOR USE WITH AN OXYGEN CONCENTRATOR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Oxygen concentrators have been available for many years as a source of oxygen enriched air for patients requiring supplemental oxygen. The oxygen concentrator includes a filter element which passes oxygen while blocking the flow of nitrogen. This will typically result in a gas which is up to about 95% pure oxygen, with at maximum separation efficiency the remainder of the gas being primarily argon. An oxygen concentrator is not designed for portable applications because of its size, weight and power requirements. Typically, an ambulatory patient requiring supplemental oxygen will carry a relatively small container containing either compressed gaseous oxygen or liquefied oxygen. In the past, the portable compressed gaseous oxygen cylinders were filled from a larger container of compressed oxygen. The system may include a flow controller which delivers oxygen pulses only during inspiration to conserve oxygen and thus prolong the ambulatory time for the patient. Recently, oxygen concentrators have sometimes been provided with a compressor suitable for compressing the oxygen enriched air sufficiently for filling a portable oxygen cylinder. Another recent development is apparatus which cools and liquefies the oxygen enriched air from an oxygen concentrator for filling portable liquid oxygen containers.

When oxygen is to be breathed by a patient, it is critical that the oxygen not be contaminated. If a portable oxygen cylinder is completely empty prior to filling, there is a risk that the cylinder valve may have been left open and that the interior of the cylinder has become contaminated. For patient safety, it is necessary that an empty oxygen cylinder be cleaned and flushed with oxygen prior to filling to remove any possible contaminants that may have entered the cylinder. To avoid this problem, the Compressed Gas Association has recommended that gaseous oxygen cylinders not be emptied below 25 psig. The Association recommends that the tank pressure be manually checked prior to filling.

U.S. Pat. No. 4,856,284 to Mattiola et al. discloses a system for automatically filling a liquid gas cylinder. Prior to filling the cylinder, the cylinder is evacuated. As gas is evacuated from the cylinder, it is automatically analyzed for contamination to prevent filling a contaminated cylinder.

BRIEF SUMMARY OF THE INVENTION

The invention is directed to an oxygen concentrator which is capably of supplying oxygen enriched air of from about 85% to about 95% oxygen concentration to a patient and/or to a compressor or a cooler for filling a portable gaseous or liquid oxygen cylinder for use by an ambulatory patient. The oxygen concentrator includes a programmed cycle for automatically filling the oxygen cylinder to a programmed maximum pressure. The cylinder pressure is constantly monitored during the fill cycle. According to the invention, the initial cylinder pressure is compared with a programmed minimum acceptable pressure, such as 100 psig. If the cylinder pressure falls below the programmed minimum acceptable pressure, the oxygen concentrator is prevented from filling the cylinder. Consequently, an empty cylinder which may be contaminated cannot be filled. The patient must take the empty cylinder to a dealer who is qualified to check for contaminants prior to filling the cylinder.

Accordingly, it is an object of the invention to provide a cylinder filling oxygen concentrator which cannot automatically fill an empty oxygen cylinder which may be contaminated.

Other objects and advantages of the invention will become apparent from the following detailed description of the invention and the accompanying drawings.

DETAILED DESCRIPTION OF THE INVENTION

Figure 1:
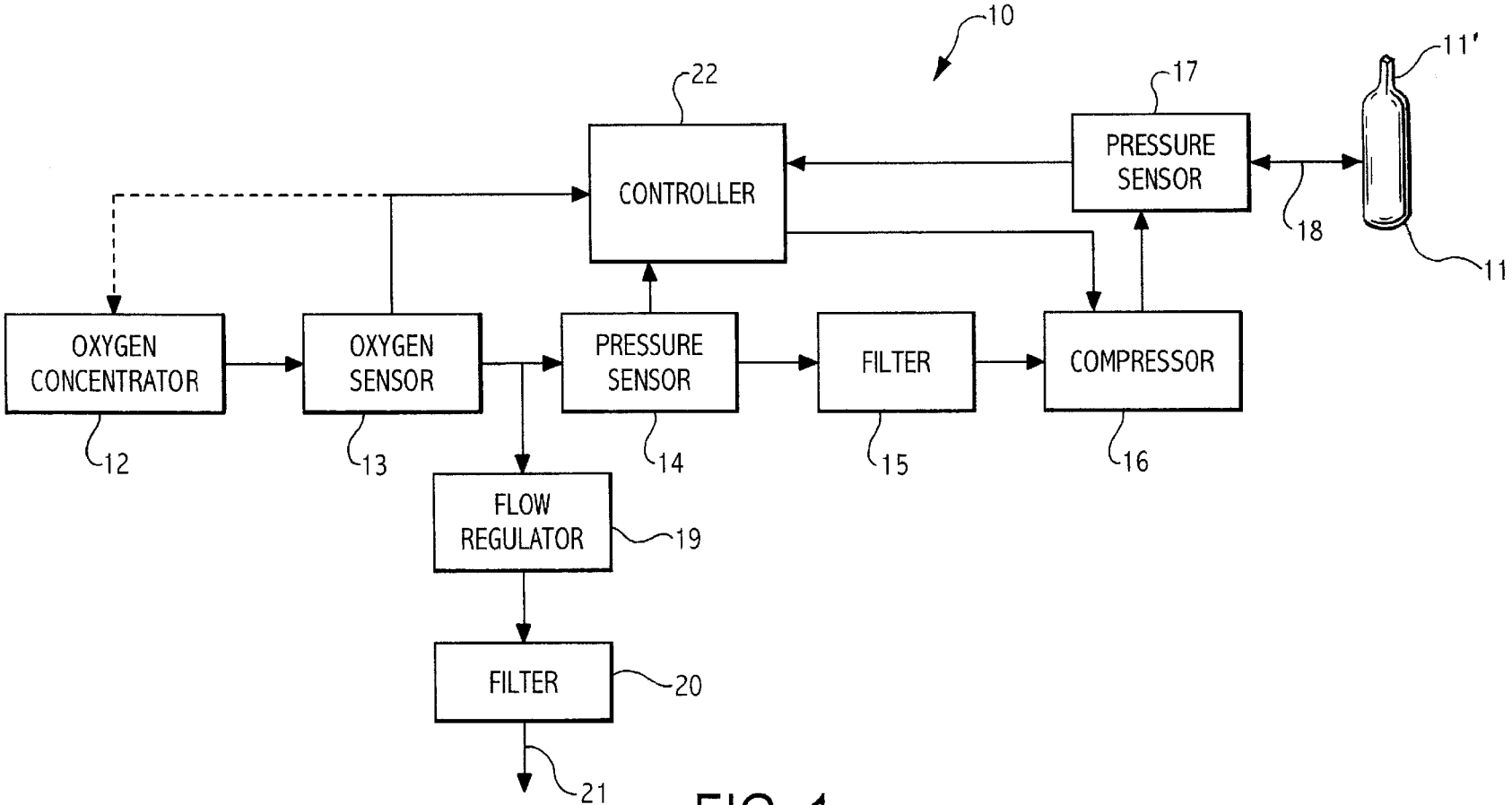
FIG. 1 is a block diagram of an oxygen concentrator and compressor connected for automatically filling an oxygen cylinder with oxygen enriched air according to the invention.

Referring to FIG. 1, apparatus 10 is shown according to the invention for filling a portable oxygen cylinder 11 with oxygen enriched air from an oxygen concentrator 12. The oxygen concentrator 12 may be of a conventional design which includes one or more molecular sieve beds (not shown) which pass oxygen and argon and block the passage of nitrogen. Each molecular sieve bed is cycled between a filter cycle wherein nitrogen is separated from air and a purge cycle wherein the beds are back flushed to purge nitrogen. When two molecular sieve beds are provided, the beds are operated alternately in filter and purge cycles. The oxygen enriched air from the concentrator 12 will be up to about 95% oxygen and about 5% argon. Frequently, the oxygen enriched air output from the concentrator 12 passes through. an oxygen sensor 13 which determines the percentage of oxygen in the output from the concentrator 12. The oxygen sensor 13 may be a component of the oxygen concentrator 12, or it may be a separate element through which the oxygen enriched air output from the concentrator 12 flows. If the sensed oxygen level falls below a preset minimum acceptable level, such as 85% oxygen, the oxygen concentrator 12 may be shut off and/or an alarm may be sounded to alert the patient that service is required. Alternately, the output from the concentrator 12 can be diverted from use by a patient and/or from filling the oxygen cylinder 11 when the concentration is below a minimum acceptable level, such as when the concentrator 12 is first started.

From the optional oxygen sensor 13, the oxygen enriched air is connected to flow through a pressure sensor 14 and a bacteria filter 15 to the inlet of a compressor 16. The high pressure output from the compressor 16 is applied through a pressure sensor 17 to a hose 18 connected for filling the oxygen cylinder 11. The hose 18 is connected to the cylinder 11 with a suitable fitting (not shown) which engages a cylinder fitting 11'. From the optional oxygen sensor 13, the oxygen enriched air also may flow through a flow regulator 19 and a bacteria filter 20 to a hose 21 for delivery to a patient, for example, through a nasal cannula (not shown).

According to the invention, the apparatus 10 includes a controller 22 for automatically filling the oxygen cylinder 11. Depending on the output capacity of the oxygen concentrator 12, the oxygen cylinder 11 may be filled either simultaneously while supplemental oxygen is supplied to the patient, or while the patient receives supplemental oxygen from another source. Preferably, the oxygen concentrator 12 has a sufficient capacity to simultaneously supply the patient's needs and to permit filling the oxygen cylinder 11. For example, an oxygen concentrator 12 having an oxygen enriched air output flow capacity of between 5 and 6 lpm (liters per minute) can deliver a flow of between ½ lpm and 3 lpm of oxygen enriched air to the patient, depending on the prescribed needs of the patient, and simultaneously deliver a flow of between 1 and 2 lpm to the compressor 16 for filling the oxygen cylinder 11.

According to the invention, a controller 22 controls the compressor 16 for filling the oxygen cylinder 11. The controller 22 has data inputs which receive data from the optional oxygen sensor 13, the pressure sensor 14 and the pressure sensor 17 and an output which controls the compressor 16. When an oxygen cylinder 11 is connected to the hose 18 and the valve on the cylinder 11 is opened, the pressure sensor 17 detects any residual gas pressure in the oxygen cylinder 11. If the measured gas pressure within the cylinder 11 falls below a predetermined safe minimum pressure above the ambient atmospheric pressure, the controller 22 is programmed to prevent the compressor 16 from operating to fill the oxygen cylinder 11. Preferably, the minimum acceptable pressure in the oxygen cylinder 11 is about 100 psig. However, it may be set to a lower level such as about 25 psig. By requiring at least a minimum cylinder pressure before filling the cylinder, the risk of filling an empty cylinder which possibly has been subject to contamination infiltration is eliminated.

The apparatus 10 also is designed to prevent filling the oxygen cylinder 11 with gas having less than a predetermined minimum oxygen concentration. A normally functioning oxygen concentrator 12 will produce an output gas having an oxygen concentration of between about 85% and about 95% . If the output falls below about 85% oxygen, the concentrator 12 requires servicing. Also, after an oxygen concentrator is first turned on there is a delay before its output reaches at least 85% oxygen. If the oxygen sensor 13 is an integral component of the oxygen concentrator 12, the output from the oxygen concentrator 12 may be vented to atmosphere until it reaches the required minimum concentration level. If during operation of the concentrator 12 the output gas oxygen concentration falls from an acceptable level to an unacceptable level, such as below 85% , the oxygen sensor 13 may be connected to sound an alarm. The oxygen sensor 13 may provide data to the programmed controller 22 for use in controlling the compressor 16. For example, after starting the oxygen concentrator 12, the compressor 16 may be prevented from operating to begin filling the oxygen cylinder 11 until the oxygen sensor 13 detects at least 85% oxygen concentration in the concentrator output gas. If the apparatus 10 does not include an oxygen sensor 13, the controller 22 may use data from the pressure sensor 14 for timing the beginning of filling the oxygen cylinder 11. For example, if commercially available oxygen concentrators take a maximum of 15 minutes to warm up before they product an output gas with at least 85% oxygen concentration, the controller 22 may measure an elapse time of 15 minutes from when the low pressure output from the concentrator 12 is applied to the pressure sensor 14 before starting the compressor 16 for filling the oxygen cylinder 11.

It will be appreciated that various modifications and changes may be made to the above described preferred embodiment of a cylinder filling oxygen concentrator without departing from the scope of the following claims. For example, the apparatus 10 was illustrated and described as having a compressor 16 for filling an oxygen cylinder 11 with gaseous oxygen. It will be appreciated that the compressor 16 may be replaced with cooling apparatus which liquefies the oxygen enriched air for filling the cylinder 11 with liquefied oxygen enriched gas.

What is claimed is:

1. A process for filling an oxygen cylinder comprising the steps of:

a) connecting said oxygen cylinder to a source of compressed oxygen rich gas;

b) automatically measuring the gas pressure within said connected oxygen cylinder; and c) so long as the measured gas pressure within said connected oxygen cylinder is at least a predetermined minimum pressure greater than the ambient atmospheric pressure, automatically filling said connected oxygen cylinder with oxygen rich gas to a predetermined maximum pressure with compressed oxygen from said source, and preventing the automatic filling of said connected oxygen cylinder with oxygen rich gas if the measured gas pressure in said connected oxygen cylinder is below said predetermined minimum pressure.

2. A process for filling an oxygen cylinder, as set forth in claim 1, and wherein said oxygen cylinder is connected to a source of compressed oxygen rich gas consisting of a high pressure outlet from a compressor having an inlet connected to receive low pressure oxygen rich gas from an oxygen concentrator.

3. A process for filling an oxygen cylinder, as set forth in claim 2 and wherein the automatic filling of said connected oxygen cylinder is prevented if the measured gas pressure in the oxygen cylinder falls below a predetermined minimum pressure by preventing operation of said compressor.

4. A process for filling an oxygen cylinder, as set forth in claim 1, and wherein the automatic filling of said connected oxygen cylinder is prevented if the measured gas pressure falls below about 100 psig.

5. A process for filling an oxygen cylinder, as set forth in claim 1, and wherein the automatic filling of said connected oxygen cylinder is prevented if the measured gas pressure falls below about 25 psig.

6. A process for filling an oxygen cylinder comprising the steps of.

a) providing an oxygen concentrator having an oxygen enriched air outlet;

b) applying oxygen enriched air from said oxygen concentrator outlet to a compressor, said compressor, when operating, having a high pressure oxygen enriched air outlet;

c) connecting said oxygen cylinder to said high pressure oxygen enriched air outlet from said compressor;

d) automatically measuring the gas pressure within said connected oxygen cylinder; and e) so long as the measured gas pressure within said connected oxygen cylinder is at least a predetermined minimum pressure greater than the ambient atmospheric pressure, automatically operating said compressor to fill said connected oxygen with compressed oxygen enriched air, and preventing the automatic filling of said oxygen cylinder if the measured pressure in said connected oxygen cylinder is below said predetermined minimum pressure.

7. A process for filling an oxygen cylinder, as set forth in claim 6 and wherein the automatic filling of said connected oxygen cylinder is prevented if the measured gas pressure in the oxygen cylinder falls below a predetermined minimum pressure by preventing operation of said compressor.

8. A process for filling an oxygen cylinder, as set forth in claim 7, and wherein the automatic filling of said connected oxygen cylinder is prevented if the measured gas pressure falls below about 100 psig.

9. A process for filling an oxygen cylinder, as set forth in claim 7, and wherein the automatic filling of said connected oxygen cylinder is prevented if the measured gas pressure falls below about 25 psig.

* * * * *